United States Patent [19]

Willard

[11] Patent Number: 4,641,117

[45] Date of Patent: Feb. 3, 1987

[54] COMBINED ACCESSORY AND TRIP ACTUATOR UNIT FOR ELECTRONIC CIRCUIT BREAKERS

[75] Inventor: Henry G. Willard, Wethersfield, Conn.

[73] Assignee: General Electric Company, New York, N.Y.

[21] Appl. No.: 759,979

[22] Filed: Jul. 29, 1985

[51] Int. Cl.[4] ..... H01H 83/12

[52] U.S. Cl. ..... 335/7; 335/180; 335/268

[58] Field of Search ..... 335/20, 166, 180, 254, 335/256, 7

[56] References Cited

U.S. PATENT DOCUMENTS

| | | | |
|---|---|---|---|
| 3,088,009 | 4/1963 | Perez del Valle | 335/6 |
| 3,248,499 | 4/1966 | Young | 335/256 |
| 3,293,577 | 12/1966 | Kiesel et al. | 335/20 |
| 3,693,122 | 9/1972 | Willard | 335/174 |
| 3,755,766 | 8/1973 | Read, Jr. | 335/236 |
| 3,783,423 | 1/1974 | Mater et al. | 335/174 |
| 3,886,507 | 5/1975 | Johnston et al. | 335/234 |
| 4,013,926 | 3/1977 | Lang et al. | 335/7 |
| 4,097,831 | 6/1978 | Jencks et al. | 335/166 |
| 4,489,295 | 12/1984 | Altenhof, Jr. et al. | 335/20 |

*Primary Examiner*—Steven L. Stephan
*Assistant Examiner*—W. Morris Worth
*Attorney, Agent, or Firm*—Richard A. Menelly; Walter C. Bernkopf; Fred Jacob

[57] ABSTRACT

A modified electronic trip unit actuator provides remote trip and undervoltage release function without impairing the actuator reliability. One embodiment replaces the permanent magnet of a flux shift trip unit actuator with an undervoltage release coil for undervoltage facility and a further embodiment uses the combination of a permanent magnet with a shunt trip coil for remote tripping function.

5 Claims, 3 Drawing Figures

COMBINED ACCESSORY AND TRIP ACTUATOR UNIT FOR ELECTRONIC CIRCUIT BREAKERS

BACKGROUND OF THE INVENTION

The advent of an electronic trip unit for circuit protection has resulted in a sophisticated means of controlling the trip parameters by careful selection of overcurrent values and time overcurrent durations. Such circuits are capable of further providing ground fault circuit protection by the addition of ground fault sensing transformers and additional circuitry.

When undervoltage protection is required along with overcurrent protection some electromechanical undervoltage release means must be added to the circuit breaker in addition to the electronic trip unit. U.S. Pat. No. 4,301,434 in the name of Roger N. Castonguay describes one such undervoltage release reset and lockout apparatus for use with electronic trip units to provide undervoltage protection.

U.S. Pat. No. 4,408,174 in the name of Raymond K. Seymour et al. discloses a multifunctional mounting module for shunt trip, undervoltage and remote signalling by means of a common accessory mounting module for use with electronic trip units to provide a plurality of electromechanical accessory functions.

U.S. Pat. No. 3,693,122 in the name of Henry G. Willard discloses a flux transfer trip device for electronic trip units wherein the flux provided by a permanent magnet is opposed by a magneto-motive force produced by a solenoid winding. A flux diverter interposed between the permanent magnet and the spring-biased tripping armature provides instantaneous trip properties by effectively de-coupling the permanent magnet flux by operation of the solenoid winding. The Willard flux transfer trip device is currently used in combination with the aforementioned electromechanical accessory apparatus to provide remote tripping as well as undervoltage protection to the protected circuit.

An earlier attempt to provide an electronic trip unit along with undervoltage protection is described within U.S. patent application Ser. No. 674,451 filed Nov. 23, 1984 entitled "Bistable Undervoltage Release Circuit For Circuit Breakers" in the name of E. K. Howell. This circuit utilizes a bistable undervoltage release function whereby a first signal to a solenoid coil holds the armature against a spring force. A second signal of opposite polarity produces an opposing magnetic flux to cancel that retained by the solenoid. The armature becomes extended under the influence of the charged spring to trip the breaker. A control signal is developed within a sensing circuit to determine the presence of either undervoltage or overcurrent to operate the solenoid to trip the breaker upon command. U.S. Pat. No. 4,013,926 discloses a combined trip actuator and undervoltage release mechanism wherein the undervoltage coil and trip release coils are co-axially arranged relative to the solenoid plunger. It is believed that the present invention improves over the teachings of this patent by arranging the undervoltage coil with the solenoid plunger. This arrangement provides the required electrical immunity between the undervoltage and overcurrent coils. The aforementioned U.S. Patents and Patent Application are incorporated herein for purposes of reference.

The purpose of the instant invention is to disclose a flux transfer trip device having both undervoltage and remote trip facility within a common housing and which can be utilized with an electronic trip unit with only slight modification to the flux transfer device and no modification to the electronic trip circuit.

SUMMARY OF THE INVENTION

A combined low energy electronic circuit breaker trip actuator, undervoltage release and remote trip device is provided by means of a modified flux transfer trip unit actuator. For undervoltage release function, the trip unit actuator permanent magnet is replaced by an undervoltage release coil in magnetic association with the trip actuating solenoid. A remote trip function is provided by a separate shunt trip coil arranged in magnetic association with the flux transfer permanent magnet for reducing the permanent magnet flux to release the armature and trip the breaker under a stored spring bias.

DESCRIPTION OF THE PREFERRED EMBODIMENT

Figure 1:
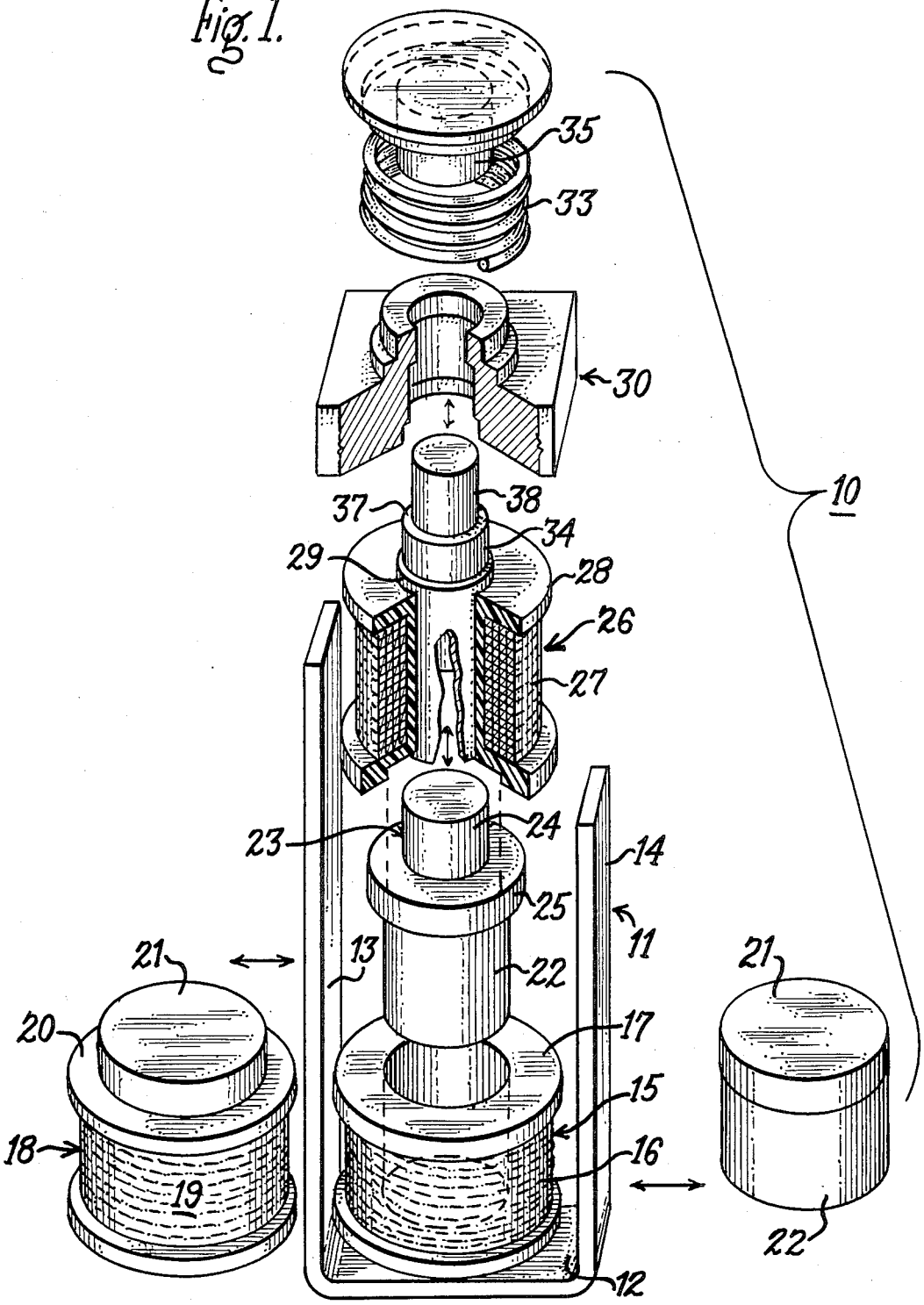
FIG. 1 is a front perspective view in isometric projection of the components used to form the combined accessory-trip actuator unit of the invention.

The combined accessory-trip actuator unit 10 of the invention is shown in FIG. 1 prior to assembly on automated equipment. A side frame assembly 11 consisting of first and second upstanding side arms 13, 14 connected by a generally planar bight portion 12 is arranged as indicated prior to insertion of either an undervoltage release coil 15, consisting of an undervoltage release winding 16 arranged on a bobbin 17, to provide undervoltage release facility or a shunt trip coil 18, consisting of a shunt trip winding 19 arranged around a bobbin 20 subjacent a permanent magnet 21, within the side frame assembly. To reduce the number of components to be inventoried, a standard size side frame assembly is employed and the permanent magnet 21 is arranged over a spacer 22 to result in a uniform spacing between the bight portion 12 of the side frame assembly 11 and the flux diverter unit 23 when a trip actuator without accessory function is required. Alternatively, a shortened side frame assembly can be employed with a standard sized permanent magnet should a flux shift actuator be required without the undervoltage or shunt trip accessory as described within the aformentioned Patent to Henry Willard.

Figure 2:
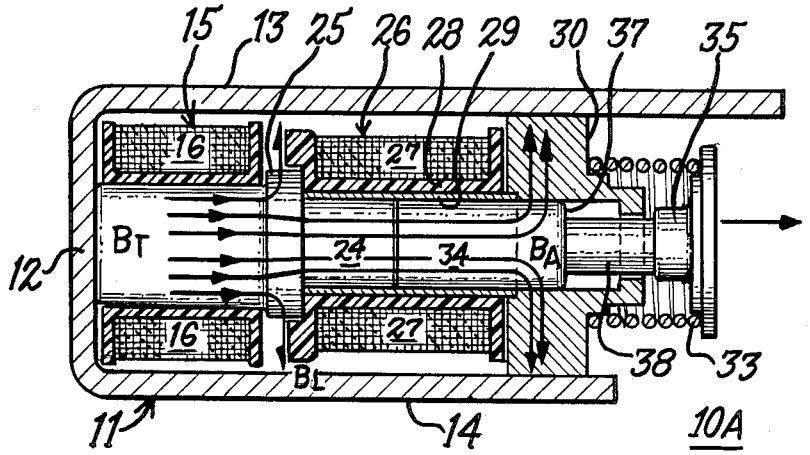
FIG. 2 is a side sectional view of the combined accessory trip actuator unit of the invention assembled as an undervoltge release device.

To provide the combined trip actuator and undervoltage release unit 1OA shown in FIG. 2, the undervoltage release coil 15 is positioned between the side arms 13, 14, and arranged on the bight portion 12 as indicated. The flux diverter pedestal 25 is arranged such that the diverter body member 24 extends up within the trip coil 26 and is concentrically arranged within the guide 29. As fully described within the aformentioned Patent to Willard, the flux diverter comprises a magnetizable material such as soft iron and the guide 29 is a non-ferrous metal such as aluminum, copper or brass. The trip bobbin 28, on which the trip winding 27 is arranged is made of a molded plastic material. The flux lines $B_T$ (shown in FIG. 2) produced by the energized undervoltage release coil 15 transfers through the flux diverter with some loss of flux, indicated as $B_L$, resulting in an armature flux $B_A$ which provides a flux path across the spring support member 30 to the respective sidewalls 13, 14 to hold the armature 34 against the bias provided by the compression spring 33. The armature body 37 is connected to an armature cap 35 by means of a stem 38. The armature flux $B_A$ is adjusted by varying the number of turns comprising the undervoltage winding 16 within the undervoltage release coil 15 to provide a sufficient holding flux when a predetermined voltage is applied to the undervoltage release coil. When the voltage ceases to exist or dips below the predetermined voltage for a predetermined time, the available flux on the armature, $B_A$, becomes insufficient to hold the armature against the force of the charged spring thereby causing the armature to extend in the forward indicated direction to contact the circuit breaker trip bar (not shown) to trip the breaker. Should a tripping operation be required because of an overcurrent condition as sensed by the circuit breaker trip unit (not shown) the trip coil 26 is energized to produce an opposing flux resulting in a rapid and substantial increase in $B_L$ with a corresponding decrease in $B_A$ to cause the armature to extend in the indicated direction under the urgence of the charged compression spring 33. It is to be noted that the inclusion of the undervoltage release coil 15 does not in any way interfere with the operation of the trip actuating mechanism, as just described.

Figure 3:
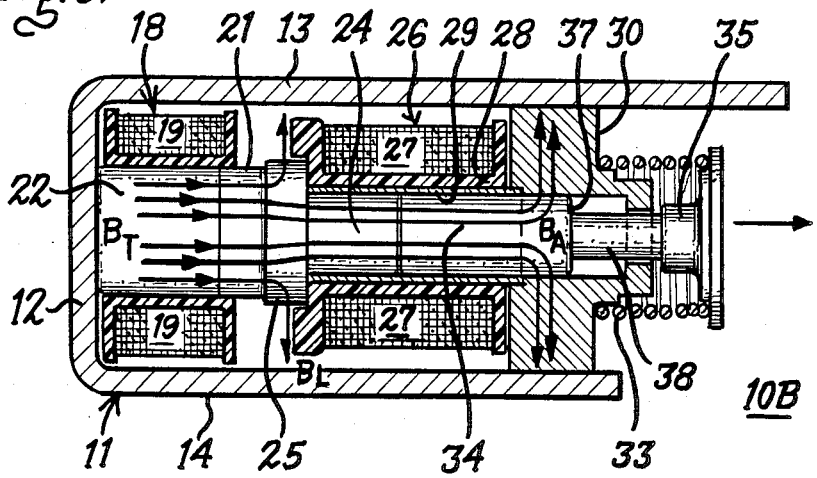
FIG. 3 is a side sectional view of the combined accessory-trip actuator unit of the invention assembled as a shunt trip device.

A combined shunt trip and trip actuator unit 1OB is shown in FIG. 3. The shunt trip coil 18 and permanent magnet 21 are placed between the opposing sidewalls 13, 14 over the bight portion 12 as indicated. The flux diverter pedestal 25 is positioned over the permanent magnet and the flux diverter body 24 extends within the trip coil 26 in a manner similar to that described earlier for the combined undervoltage release and trip actuator unit 10A. The total magnetic flux $B_T$ is reduced by means of the leakage flux $B_L$ out through the diverter pedestal 25 and the remaining flux $B_A$ holds the armature 34 against the spring force provided by the charged compression spring 33. The total flux $B_T$ in this embodiment is provided by the permanent magnet 21 and the shunt trip function occurs by excitating the shunt trip coil 18 to produce a flux in opposition to $B_T$ which thereby causes a substantial decrease in $B_A$. The armature 34 becomes extended under the urgence of the charged compression spring 33 to move in the indicated direction. The trip coil 26 itself can be energized independent from the trip unit to decrease $B_A$ to cause the armature to become extended under the urgence of the charged compression spring 33, such that the shunt trip coil 18 can be omitted for a less expensive shunt trip and trip actuator unit if so desired. However, it has been determined that the use of a separate shunt trip coil 18 is preferred because of the stringent noise-free requirements for the trip unit circuit components.

Alternatively, the permanent magnet 21 and shunt trip coil 18 can be eliminated and the combined undervoltage release and trip actuator unit 1OA, in FIG. 2, can also be used for shunt tripping. This is made possible by the provision of a series switch in one of the power leads (not shown) to the undervoltage release windings 16 for a less expensive combined shunt trip and undervoltage release-trip actuator unit. Switching off the voltage to the undervoltage winding would result in a tripping operation causing the armature to extend in the same manner as described earlier.

It has thus been shown that a flux transfer type trip actuator unit can be adapted to include both undervoltage and shunt trip auxiliary function with minor modifications. When a uniform side frame is selected, the undervoltage and shunt trip functions can be provided in an automated down-loaded operation with a substantial reduction in the number of inventoried parts required with the present method of providing undervoltage and shunt trip accessories as separate and independent units.

Having described my invention, what I claim as new and desire to secure by Letters Patent is:

1. A combined trip actuator and undervoltage release for electronic circuit breakers comprising:

magnetic support means;

a trip coil mounted within said support means having a movable armature extending partially within said trip coil and biased into a tripping position by a compression spring:

an undervoltage release coil within said support means providing a predetermined magnetic holding flux to retain said armature in a non-trip position against said compression spring when said undervoltage release coil is energized by a first predetermined voltage; and a magnetic flux diverter intermediate said undervoltage release coil and said trip coil for diverting said magnetic holding flux away from said armature when said trip coil is energized to allow said armature to extend to said tripping position under the urgence of said compression spring, said flux diverter comprising a dual-diameter magnetic cylinder the smaller diameter being arranged partially within said trip coil, the larger diameter being arranged in abutment with said undervoltage release coil, said undervoltage release coil providing less than said predetermined holding flux to said armature when said undervoltage release coil is energized by a voltage less than said predetermined voltage whereby said armature becomes extended to said tripping position under the urgence of said compression spring.

2. The combined trip actuator and undervoltage release of claim 1 wherein said larger diameter is arranged closer to said side walls than said smaller diameter for promoting magnetic flux transfer between said flux diverter and said sidewalls.

3. The combined trip actuator and undervoltage release of claim 1 wherein said armature includes a body member extending partially within said trip coil and a stem member extending partially outside said trip coil and connected with said armature body member and with an armature cap.

4. The combined trip actuator and undervoltage release of claim 3 including a chambered metallic support member intermediate said trip coil and said compression spring whereby said armature body passes through said channel.

5. The combined trip actuator and undervoltage release of claim 4 wherein said metallic support provides magnetic holding flux path means for coupling said magnetic holding flux to said sidewalls to hold said armature body within said trip coil against said compression spring bias.

* * * * *